US010749272B2

(12) United States Patent
Wu et al.

(10) Patent No.: US 10,749,272 B2
(45) Date of Patent: Aug. 18, 2020

(54) DUAL-POLARIZED MILLIMETER-WAVE ANTENNA SYSTEM APPLICABLE TO 5G COMMUNICATIONS AND MOBILE TERMINAL

(71) Applicant: SHENZHEN SUNWAY COMMUNICATION CO., LTD., Shenzhen, Guangdong (CN)

(72) Inventors: Shengjie Wu, Shenzhen (CN); Anping Zhao, Shenzhen (CN)

(73) Assignee: SHENZHEN SUNWAY COMMUNICATION CO., LTD., Shenzhen (CN)

( * ) Notice: Subject to any disclaimer, the term of this patent is extended or adjusted under 35 U.S.C. 154(b) by 21 days.

(21) Appl. No.: 16/276,731

(22) Filed: Feb. 15, 2019

(65) Prior Publication Data

US 2019/0386400 A1 Dec. 19, 2019

Related U.S. Application Data

(63) Continuation of application No. PCT/CN2019/072003, filed on Jan. 16, 2019.

(30) Foreign Application Priority Data

Jun. 15, 2018 (CN) ..... 2018 1 0620888

(51) Int. Cl.
*H01Q 1/38* (2006.01)
*H01Q 21/24* (2006.01)
(Continued)

(52) U.S. Cl.
CPC ..... *H01Q 21/24* (2013.01); *H01Q 5/371* (2015.01); *H01Q 15/04* (2013.01)

(58) Field of Classification Search
CPC ..... H01Q 21/24; H01Q 15/04; H01Q 5/371
See application file for complete search history.

(56) References Cited

U.S. PATENT DOCUMENTS 6,137,444 A 10/2000 Pettersson et al.
9,865,928 B2 1/2018 Sudo et al.
(Continued)

FOREIGN PATENT DOCUMENTS

CN 104167611 A 11/2014
CN 104662737 A 5/2015
(Continued)

OTHER PUBLICATIONS

Mar. 28, 2019 International Search Report issued in International Patent Application No. PCT/CN2019/072003.
(Continued)

*Primary Examiner* — Dieu Hien T Duong
(74) *Attorney, Agent, or Firm* — Oliff PLC

(57) ABSTRACT

A dual-polarized millimeter-wave antenna system applicable to 5G communications and a mobile terminal are disclosed. Each antenna element comprises a radiating body and a director, wherein the radiating body comprises a first dielectric layer, a main radiating part, a first feeding branch, a second feeding branch, a third feeding branch and a fourth branch, and the director comprises a second dielectric layer, a first director part and a second director part. The director has the same effect on a +45° polarization pattern and a −45° polarization pattern of the radiating body, so that wide-angle coverage is realized, and the consistency of the two polarization patterns is good; and the antenna system occupies a small area does not need a clearance area and can be placed on a complete metal ground plate, there by being suitable for full-screen equipment.

18 Claims, 8 Drawing Sheets

(51) Int. Cl.
*H01Q 15/04* (2006.01)
*H01Q 5/371* (2015.01)

(56) References Cited

U.S. PATENT DOCUMENTS

| | | | | |
|---|---|---|---|---|
| 2015/0194730 | A1 | 7/2015 | Sudo et al. | |
| 2015/0333407 | A1* | 11/2015 | Yamagajo | H01Q 5/40 343/905 |
| 2019/0020110 | A1* | 1/2019 | Paulotto | H01Q 5/392 |
| 2019/0058264 | A1* | 2/2019 | Jung | H01Q 25/001 |

FOREIGN PATENT DOCUMENTS

| | | | |
|---|---|---|---|
| CN | 206236783 | U | 6/2017 |
| CN | 109004337 | A | 12/2018 |
| CN | 208570910 | U | 3/2019 |

OTHER PUBLICATIONS

Jun. 27, 2019 Office Action issued in Chinese Patent Application No. 201810620888.7.

Supplementary Search Report issued in Chinese Patent Application No. 201810620888.7.

Manoj Stanley et al. "A Novel MM-Wave Phased Array for 180° Coverage for 5G Smartphone Applications". 2018 European Conference on Antennas and Propagation (EuCAP), Apr. 16, 2018, pp. 1-3.

* cited by examiner

DUAL-POLARIZED MILLIMETER-WAVE ANTENNA SYSTEM APPLICABLE TO 5G COMMUNICATIONS AND MOBILE TERMINAL

TECHNICAL FIELD

The invention relates to the technical field of communications, in particular to a dual-polarized millimeter-wave antenna system applicable to 5G communications and a mobile terminal.

DESCRIPTION OF RELATED ART

At present, in the long term evolution (LTE) system, the throughput of communication systems is improved usually by multiplying the number of antennas or dual-polarized antennas. In order to improve the throughput of a 5G communication system having a Sub-6 GHz (below 6 GHz) operating frequency range and a millimeter-wave operating frequency range, the number of antennas (namely MIMO antennas) is generally multiplied within the Sub-6 GHz frequency range; and within the millimeter-wave frequency range, the antennas have to work in an array manner due to the large attenuation during propagation within this frequency range. Meanwhile, because mobile phone terminals communicate with base stations in a point-to-point manner within the millimeter-wave bands, under the condition that dual polarization has been adopted by the base stations, the communication performance or the transmission rate can be effectively improved if the mobile phone terminals also adopt dual polarization.

Document *A Novel mm-Wave Phased Array for* 180° *coverage for* 5*G Smartphone Applications,* 2018 European Conference on Antennas and Propagation (EuCAP), 2018, London, UK, paper CS15.5. puts forwards a dual-polarized antenna system which has a wide coverage angle and works by exciting the $TM_{01}$ mode and the $TM_{10}$ mode of a microstrip antenna. However, due to the fact that the maximum radiation direction of the microstrip antenna is the broadside direction (perpendicular to the antenna), in order to shift the radiation energy towards the end-fire direction (parallel to the antenna) to fulfill wide-angle coverage, the author adds a microstrip-type Yagi antenna beside the microstrip antenna to enhance the radiation in the end-fire direction by simultaneously exciting the microstrip antenna and the Yagi antenna as shown in synthetic patterns, and thus, wide-angle coverage is fulfilled. However, there is a great difference between the synthetic patterns of the two polarization directions of the antenna system. Particularly, in one polarization direction, surface currents of the microstrip antenna and the Yagi antenna are in-phase, the performance of this synthetic pattern is excellent, and wide-angle coverage is realized; and in the other polarization direction, the surface currents of the two antennas are orthogonal, a deep pit is formed on the synthetic pattern, and thus, wide-angle coverage cannot be realized in this polarization direction. In addition, the antenna system occupies a large area and requires a clearance area, both the microstrip antenna and the Yagi antenna need to be excited when the antenna system works, and consequentially, a radio-frequency circuit is made more complex.

BRIEF SUMMARY OF THE INVENTION

The technical issue to be settled by the invention is to provide a dual-polarized millimeter-wave antenna system applicable to 5G communications and a mobile terminal. Particularly, the +45° and −45° dual-polarized antenna system fulfills wide-angle coverage in two different polarization directions, occupies a small area and is easy to fabricate in batches.

One technical solution adopted by the invention to settle the above technical issue is as follows:

A dual-polarized millimeter-wave antenna system applicable to 5G communications comprises at least six antenna elements which are arranged at intervals. Each antenna element comprises a radiating body and a director, wherein the radiating body comprises a first dielectric layer, a main radiating part, a first feeding branch, a second feeding branch, a third feeding branch and a fourth feeding branch, the main radiating part, the third feeding branch and the fourth feeding branch are located on the upper surface of the first dielectric layer, the first feeding branch and the second feeding branch are located on the lower surface of the first dielectric layer, the third feeding branch is electrically connected to the first feeding branch, and the fourth feeding branch is electrically connected to the second feeding branch; the director is arranged close to the main radiating part, and an included angle is formed between a main plane of the director and a plane where the main radiating part is located; the director comprises a second dielectric layer, a first director part and a second director part, the first director part and the second director part are separately located on two opposite sides of the second dielectric layer, and the first director part is electrically connected to the second director part.

Another technical solution adopted by the invention is as follows:

A mobile terminal comprises a metal ground plate and the dual-polarized millimeter-wave antenna system applicable to 5G communications, wherein the dual-polarized millimeter-wave antenna system is arranged close to one side of the metal ground plate.

The invention has the following beneficial effects: feeding to the director is not needed, so that the antenna system is simplified, and the cost is reduced; the director has the same effect on the two different polarization patterns, so that wide-angle coverage is achieved, and the consistency of the +45° polarization pattern and the −45° polarization pattern is good; and the antenna system of the invention occupies a small area, does not need a clearance area and can be disposed on a complete metal ground plate, thereby being suitable for full-screen equipment. The antenna system can be arranged on one side of the mobile terminal, thereby occupying a small space and facilitating light-thin and full-screen development of the mobile terminal.

REFERENCE SIGNS

Figure 1:
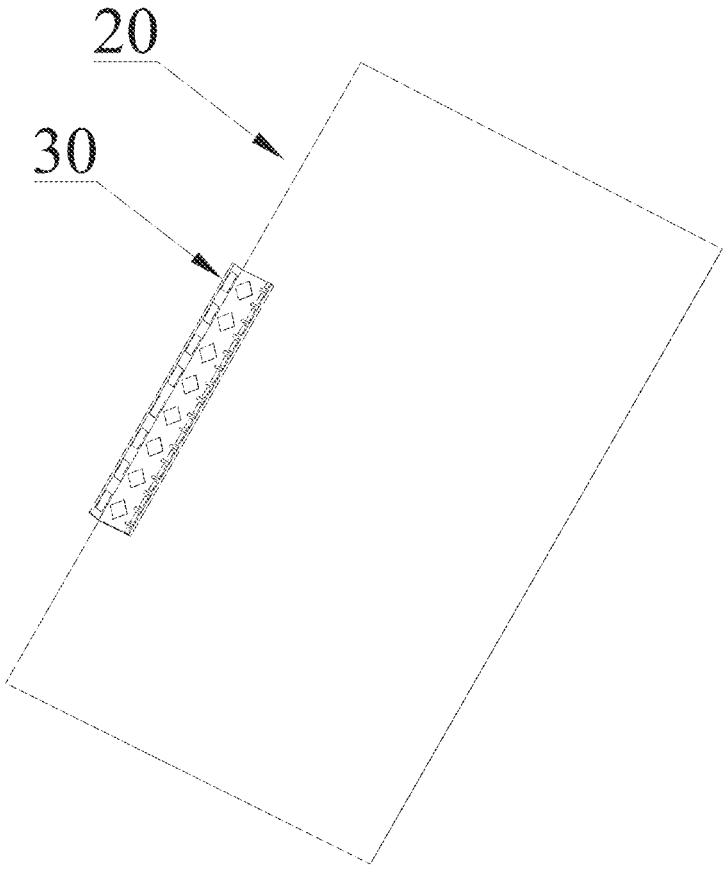
FIG. 1 is a partial structural view of a mobile terminal in embodiment 1 of the invention.
Figure 2:
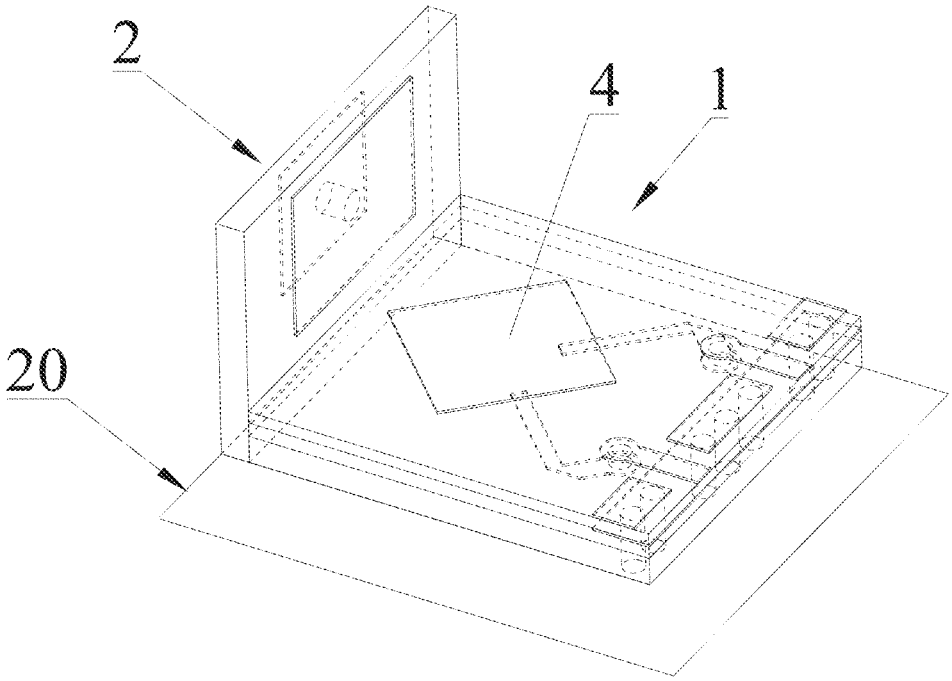
FIG. 2 is an overall structural view of an antenna element in a dual-polarized millimeter-wave antenna system applicable to 5G communications in embodiment 1 of the invention.
Figure 3:
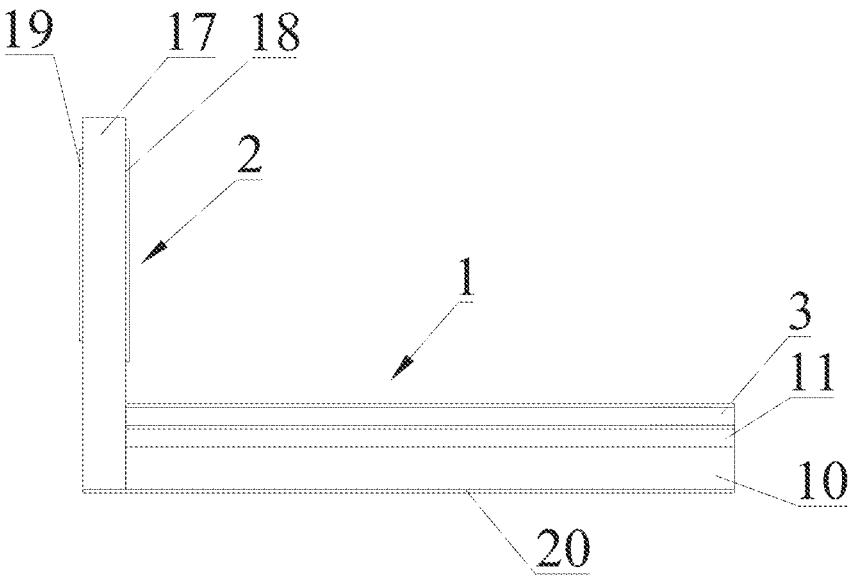
FIG. 3 is a side view of the antenna element in the dual-polarized millimeter-wave antenna system applicable to 5G communications in embodiment 1 of the invention.
Figure 4:
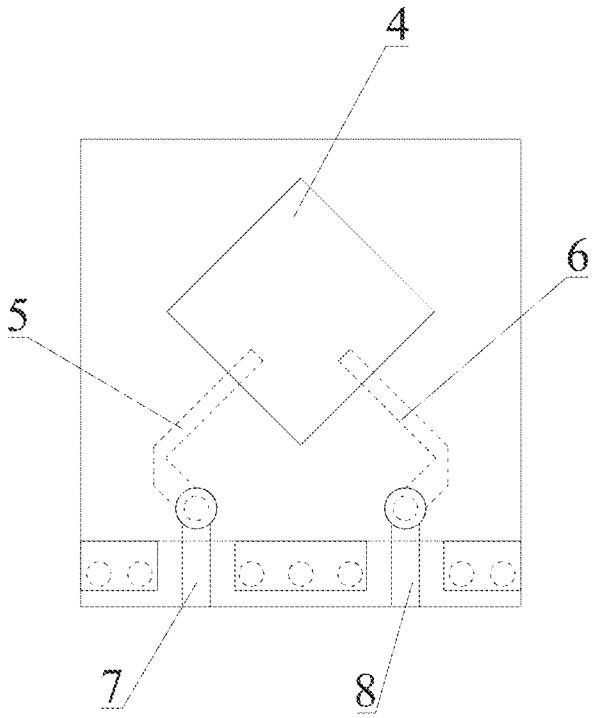
FIG. 4 is a structural view of a radiating body in the antenna element in embodiment 1 of the invention.
Figure 5:
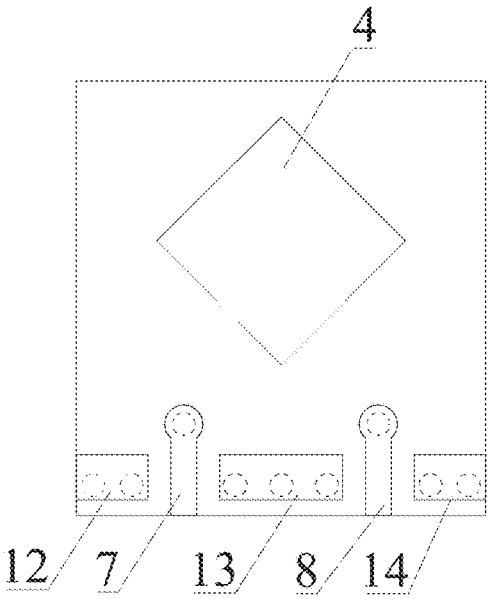
FIG. 5 is a partial structural view of the radiating body in the antenna element in embodiment 1 of the invention.
Figure 6:
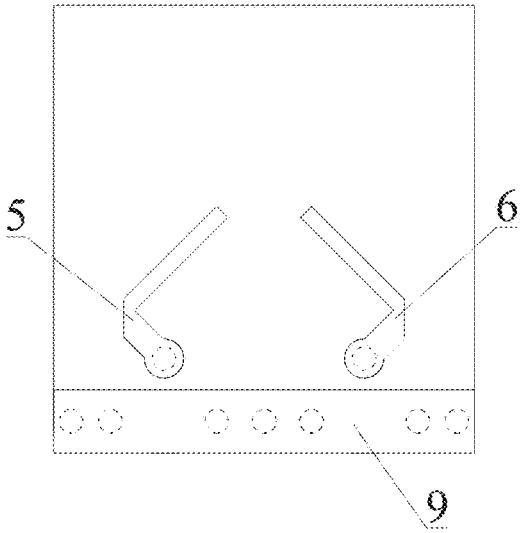
FIG. 6 is another partial structural view of the radiating body in the antenna element in embodiment 1 of the invention.
Figure 7:
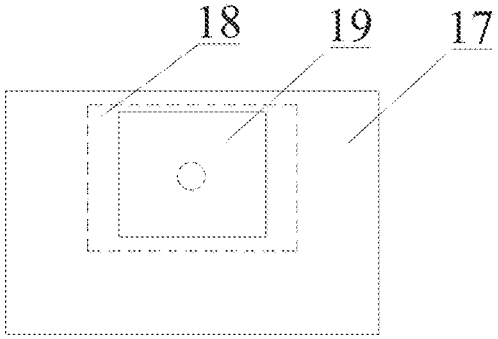
FIG. 7 is a partial structural view of a director in the antenna element in embodiment 1 of the invention.

1, radiating body; 2, director; 3, first dielectric layer; 4, main radiating part; 5, first feeding branch; 6, second feeding branch; 7, third feeding branch; 8, fourth feeding branch; 9, first ground part; 10, third dielectric layer; 11, bonding layer; 12, second ground part; 13, third ground part; 14, fourth ground part; 15, first feeding port; 16, second feeding port; 17, second dielectric layer; 18, first director part; 19, second director part; 20, metal ground plate; 30, antenna element.

DETAILED DESCRIPTION OF THE INVENTION

The technical contents, objectives and effects of the invention are detailed below with reference to embodiments and accompanying drawings.

The key conception of the invention lies in that a director is arranged at a position close to a main radiating part to generate the same effect on a +45° polarization pattern and a −45° polarization pattern of a radiating body, so that wide-angle coverage is realized, and the consistency of the two polarization patterns of the antenna system is good.

Referring to FIGS. 1-7, a dual-polarized millimeter-wave antenna system applicable to 5G communications comprises at least six antenna elements 30 which are arranged at intervals. Each antenna element 30 comprises a radiating body 1 and a director 2, wherein the radiating body 1 comprises a first dielectric layer 3, a main radiating part 4, a first feeding branch 5, a second feeding branch 6, a third feeding branch 7 and a fourth feeding branch 8; the main radiating part 4, the third feeding branch 7 and the fourth feeding branch 8 are located on the upper surface of the first dielectric layer 3, and the first feeding branch 5 and the second feeding branch 6 are located on the lower surface of the first dielectric layer 3; the third feeding branch 7 is electrically connected to the first feeding branch 5, and the fourth feeding branch 8 is electrically connected to the second feeding branch 6; the director 2 is arranged at a position close to the main radiating part 4, and an included angle is formed between a main plane of the director 2 and a plane where the main radiating part 4 is located; and the director 2 comprises a second dielectric layer 17, a first director part 18 and a second director part 19, and the first director part 18 and the second director part 19 are separately located on two opposite sides of the second dielectric layer 17, and the first director part 18 is electrically connected to the second director part 19.

From the above description, the invention has the following beneficial effects: Feeding to the director is not needed, so that the antenna system is simplified, and the cost is reduced; the main plane of the director is the plane where the second dielectric layer is located, the plane where the first director part is located and the plane where the second director part is located are parallel to the main plane, and the included angle can be set as needed; the director has the same effect on the two different polarization patterns of the radiating body, so that wide-angle coverage is realized, and the consistency of the two polarization patterns of the antenna system is good; and the shape of the first director part and the shape of the second director part can be set as needed, and the first dielectric layer and the second dielectric layer are made from insulating materials. The antenna system of the invention occupies a small area, does not need a clearance area and can be disposed on a complete metal ground plate, thereby being suitable for full-screen equipment.

Furthermore, the main radiating part 4 is rectangular or round, and the first director part 18 and the second director part 19 are rectangular or round.

From the above description, the shapes and sizes of the main radiating part, the first director part and the second director part can be set as needed, the resonant frequency of an antenna can be regulated by adjusting the size of the main radiating part, and the sizes of the first director part and the second director part are identical or different.

Furthermore, the first feeding branch 5 and the second feeding branch 6 are symmetrically arranged with respect to the main radiating part 4.

From the above description, impedance matching of the antenna element can be regulated by adjusting the lengths and widths of the first feeding branch and the second feeding branch.

Furthermore, the first feeding branch 5 and the second feeding branch 6 are in an L shape or in an arc shape.

From the above description, the shape of the first feeding branch and the shape of the second feeding branch can be set as needed.

Furthermore, the included angle is 90°.

Furthermore, the main radiating part 4 is square, and one diagonal line of the main radiating part 4 is perpendicular to the main plane of the director 2; the first feeding branch 5 and the second feeding branch 6 are in an L shape and are symmetrically arranged with respect to this diagonal line; the first feeding branch 5 comprises a first long branch and a first short branch, and the first long branch is fixedly connected with the first short branch and is perpendicular to one side of the main radiating part 4; the second feeding branch 6 comprises a second long branch and a second short branch, and the second long branch is fixedly connected with the second short branch and is perpendicular to the other side of the main radiating part 4.

From the above description, the diagonal line of the main radiating part is perpendicular to the main plane of the director, the first feeding branch and the second feeding branch are symmetrically arranged with respect to the diagonal line, the first long branch is perpendicular to one side of the main radiating part, and the second long branch is perpendicular to the other side of the main radiating part, so that dual polarization of the antenna element is facilitated, and the director has the same influence on the +45° polarization direction and the −45° polarization direction.

Furthermore, each antenna element further comprises a first ground part 9 located on the lower surface of the first dielectric layer 3.

From the above description, the antenna element can be grounded via the first ground part.

Furthermore, the radiating body 1 further comprises a third dielectric layer 10 and a bonding layer 11, wherein the third dielectric layer 10 is fixedly connected with the lower surface of the first dielectric layer 3 via the bonding layer 11.

From the above description, the whole antenna system can be fixed through the third dielectric layers.

Furthermore, the antenna element further comprises a second ground part 12, a third ground part 13 and a fourth ground part 14, wherein the second ground part 12, the third ground part 13 and the fourth ground part 14 are located on the upper surface of the first dielectric layer 3 and are electrically connected to the first ground part 9.

From the above description, the second ground part, the third ground part and the fourth ground part are arranged on the upper surface of the first dielectric layer so that the antenna element can be grounded via through holes instead of blind holes, and accordingly, the machining process is simplified.

Another technical solution of the invention is as follows:

A mobile terminal comprises a metal ground plate 20 and the dual-polarized millimeter-wave antenna system applicable to 5G communications, wherein the dual-polarized millimeter-wave antenna system is arranged close to one side of the metal ground plate 20.

From the above description, the antenna system can be disposed on one side of the mobile terminal, thereby occupying a small space and facilitating light-thin and full-screen development of the mobile terminal. Wherein, the arrangement mode of the antenna elements on the metal ground plate can be set as needed.

Referring to FIGS. 1-16, embodiment 1 of the invention is as follows:

As shown in FIG. 1, the mobile terminal comprises a metal ground plate 20 and a dual-polarized millimeter-wave antenna system applicable to 5G communications, wherein the dual-polarized millimeter-wave antenna system is arranged close to one side of the metal ground plate 20. The dual-polarized millimeter-wave antenna system comprises at least six antenna elements 30 which are arranged at intervals. Preferably, the number of the antenna elements 30 is eight, and the distances between the adjacent antenna elements 30 are identical. The arrangement mode of the antenna elements 30 on the metal ground plate 20 is not limited to the one shown in FIG. 1, and the antenna elements can be integrally rotate leftwards or rightwards by a certain angle as needed.

As shown in FIGS. 2-7, each antenna element 30 comprises a radiating body 1 and a director 2, wherein the radiating body 1 is horizontally arranged and comprises a first dielectric layer 3, a main radiating part 4, a first feeding branch 5, a second feeding branch 6, a third feeding branch 7, a fourth feeding branch 8, a first ground part 9, a third dielectric layer 10 and a bonding layer 11; the main radiating part 4, the third feeding branch 7 and the fourth feeding branch 8 are located on the upper surface of the first dielectric layer 3; the first feeding branch 5 and the second feeding branch 6 are located on the lower surface of the first dielectric layer 3; the third feeding branch 7 is electrically connected to the first feeding branch 5, for instance, via a metalized through hole; the fourth feeding branch 8 is electrically connected to the second feeding branch 6, for instance, via a metalized through hole; and the first ground part 9 is located on the lower surface of the first dielectric layer 3 and is electrically connected to the metal ground plate 20 via a metalized through hole, and the third dielectric layer 10 is fixedly connected to the lower surface of the first dielectric layer 3 through the bonding layer 11. In this embodiment, the main radiating part 4, the first feeding branch 5, the second feeding branch 6, the third feeding branch 7, the fourth feeding branch 8 and the first ground part 9 are all made from metal, the first dielectric layer 3, the third dielectric layer 10 and the bonding layer 11 are all made from insulating materials, and heights of the first dielectric layer 3, the third dielectric layer 10 and the bonding layer 11 can be set as needed. The main radiating part 4 is rectangular or round, the arrangement mode of the main radiating part 4 can be set as needed, and the resonant frequency of an antenna can be regulated by adjusting the size of the main radiating part 4. Preferably, the first feeding branch 5 and the second feeding branch 6 are symmetrically arranged with respect to the main radiating part 4 and are in an L shape or in an arc shape. When the first feeding branch 5 and the second feeding branch 6 are in an L shape, the first feeding branch 5 comprises a first long branch and a first short branch, the first long branch is fixedly connected with the first short branch and is perpendicular to one side of the main radiating part 4, the second feeding branch 6 comprises a second long branch and a second short branch, and the second long branch is fixedly connected to the second short branch and is perpendicular to the other side of the main radiating part 4. Impedance matching of the antenna element 30 can be regulated by adjusting the lengths and widths of the first feeding branch 5 and the second feeding branch 6. In this embodiment, a second ground part 12, a third ground part 13 and a fourth ground part 14 are arranged on the upper surface of the first dielectric layer 3 and are electrically connected with the first ground part 9 via metalized through holes so that the antenna element 30 can be grounded to the metal ground plate 20 through the first ground part 9, by punching through holes instead of blind holes, and machining is facilitated. The second ground part 12, the third ground part 13 and the fourth ground part 14 are made from metal.

The director 2 is arranged close to the main radiating part 4, an included angle is formed between a main plane of the director 2 and a plane where the main radiating part 4 is located, and the included angle is preferably 90°. The director 2 comprises a second dielectric layer 17, a first director part 18 and a second director part 19, wherein the first director part 18 and the second director part 19 are separately located on two opposite sides of the second dielectric layer 17 and are electrically connected, and the first director part 18 and the second director part 19 can be electrically connected via a metalized through hole. In this embodiment, the first director part 18 and the second director part 19 are rectangular or round, the size of the first director part 18 and the size of the second director part 19 can be set as needed, the area of the first director part 18 is preferably larger than that of the second director part 19, and the director 2 is used for guiding the radiation direction of the antenna element to one end. The main plane of the director 2 is the plane where the second dielectric layer 17 is located, and the plane where the first director part 18 is located and the plane where the second director part 19 is located are parallel to the main plane. In this embodiment, the first director part 18 and the second director part 19 are made from metal, and the first dielectric layer 17 is made from an insulating material.

In this embodiment, the first dielectric layer 3, the bonding layer 11 and the third dielectric layer 10 are formed through a PCB laminating process and then are integrated with the second dielectric layer 17 through a bonding process. The main radiating part 4, the first feeding branch 5, the second feeding branch 6, the third feeding branch 7, the fourth feeding branch 8, the first ground part 9, the second ground part 12, the third ground part 13, the fourth ground part 14, the first director part 18 and the second director part 19 are printed on the surfaces of the corresponding dielectric layers.

Figure 8:
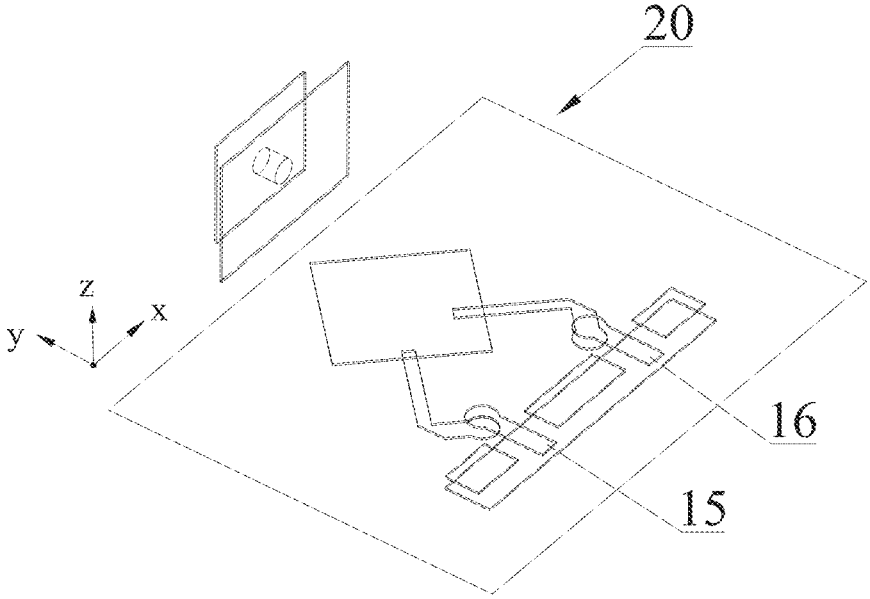
FIG. 8 is a partial structural view of the antenna element in embodiment 1 of the invention.

The performance of the +45° and −45° dual-polarized millimeter-wave antenna system is explained with an antenna system formed by the antenna element 30 shown in FIG. 8 as an example. The direction of one diagonal line of the main radiating part 4 is defined as an X direction, and the direction of the other diagonal line of the main radiating part 4 is defined as a Y direction. In FIG. 8, the main radiating part 4 is square, the diagonal line in the Y direction is perpendicular to the main plane of the director 2, the first feeding branch 5 and the second feeding branch 6 are symmetrically arranged with respect to the diagonal line in the Y direction, the first long branch of the first feeding branch 5 is perpendicular to one side of the main radiating part 4, and the second long branch of the second feeding branch 6 is perpendicular to the other side of the main radiating part 4. The first director part 18 and the second director part 19 are perpendicular to the X-Y plane in the X direction, the direction perpendicular to the X-Y plane is defined as a Z-direction, and the first director part 18 and the second director part 19 are rectangular.

Figure 9:
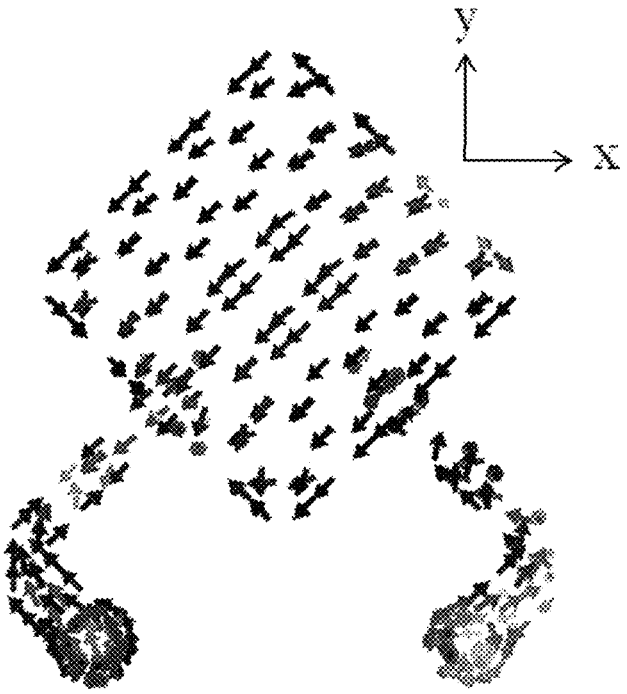
FIG. 9 is a surface current distribution diagram of the antenna element at the frequency of 28 GHz when feeding is carried out via a first feeding port in embodiment 1 of the invention.
Figure 10:
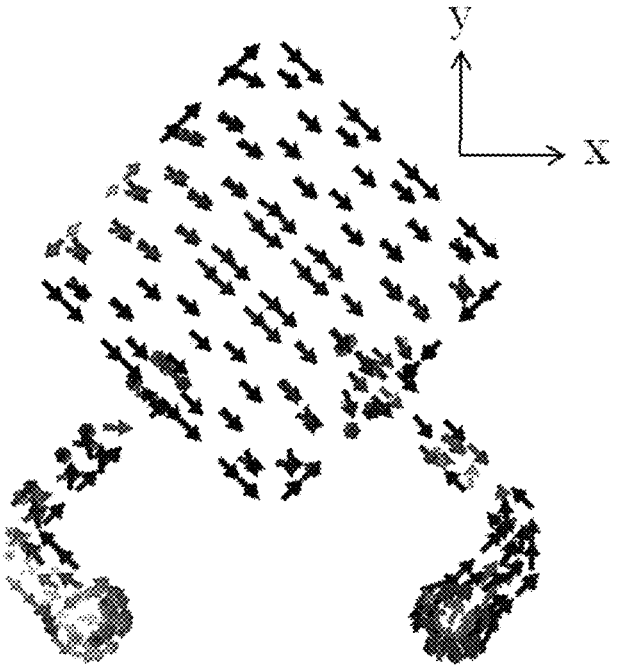
FIG. 10 is a surface current distribution diagram of the antenna element at the frequency of 28 GHz when feeding is carried out via a second feeding port in embodiment 1 of the invention.

An end, away from the main radiating part 4, of the third feeding branch 7 is provided with a first feeding port 15, and an end, away from the main radiating part 4, of the fourth feeding branch 8 is provided with a second feeding port 16. FIG. 9 and FIG. 10 are surface current distribution diagrams of the antenna element at the frequency of 28 GHz, wherein FIG. 9 is a surface current distribution diagram when feeding is carried out via the first feeding port 15, and FIG. 10 is a surface current distribution diagram when feeding is carried out via the second feeding port 16. As can be seen from FIG. 9 and FIG. 10, when feeding is carried out via any one of the two feeding ports, surface currents of the main radiating part 4 are mutually orthogonal, namely, the included angle between the current direction and the Y axis is about 45°, in this case, polarization realized when feeding is carried out via the first feeding port 15 is defined as +45° polarization, polarization realized when feeding is carried out via the second feeding port 16 is defined as −45° polarization, and thus, dual polarization of the antenna element 30 is fulfilled.

Figure 11:
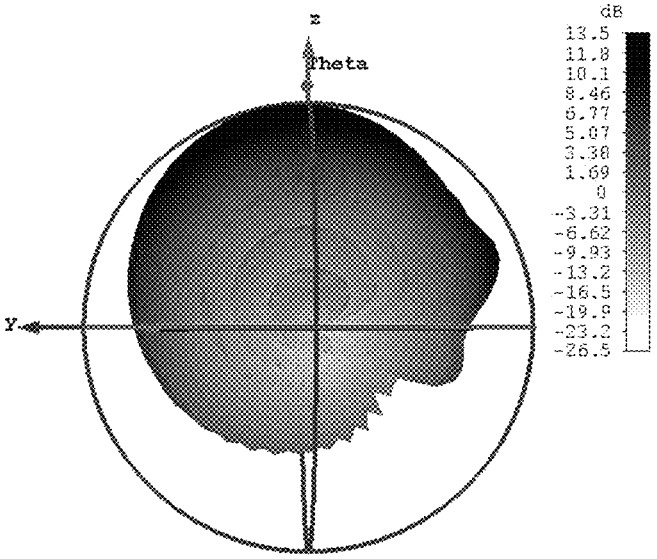
FIG. 11 is a 3D pattern of the antenna element without a director at the frequency of 28 GHz in embodiment 1 of the invention.
Figure 12:
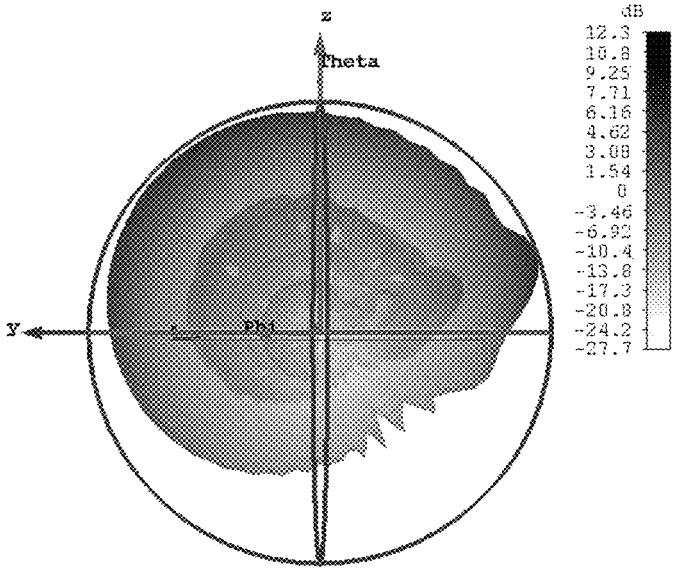
FIG. 12 is a 3D pattern of the antenna element with a director at the frequency of 28 GHz in embodiment 1 of the invention.
Figure 13:
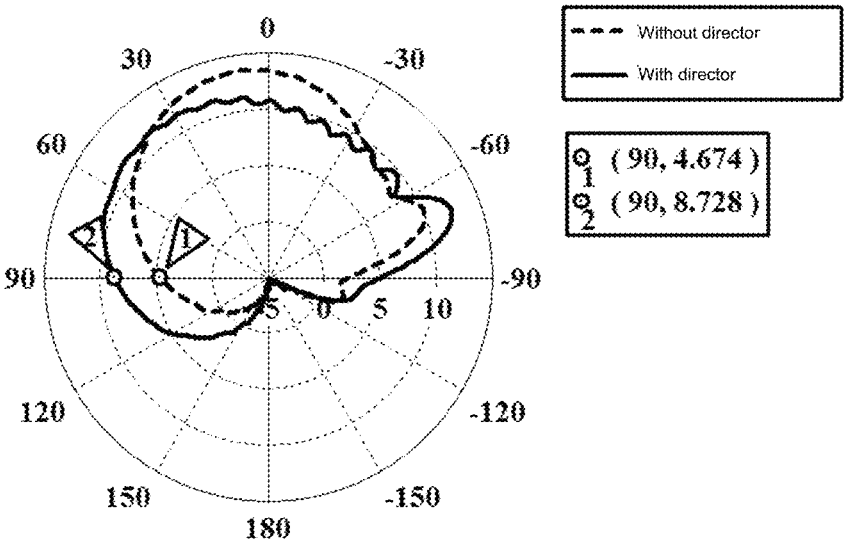
FIG. 13 is a comparative diagram of the pattern in FIG. 11 and the pattern in FIG. 12 in the YOZ plane.

Particularly, a +45° polarization pattern of the antenna system can be obtained by exciting the first feeding ports 15 of all the antenna elements 30 in the antenna system, and a −45° polarization pattern of the antenna system can be obtained by exciting the second feeding ports 16 of all the antenna elements 30 in the antenna system. As the two polarization patterns are similar, only one polarization pattern is listed herein. As shown in FIGS. 11-13, by adoption of the director 2, energy above the antenna (theta=0°) is decreased, and energy in front of the antenna (theta=90°) is increased, so that the radiation energy in the whole upper half space is more uniform, the beam coverage is widened, and the gain in front is increased to 8.7 dBi from 4.6 dBi.

Figure 14:
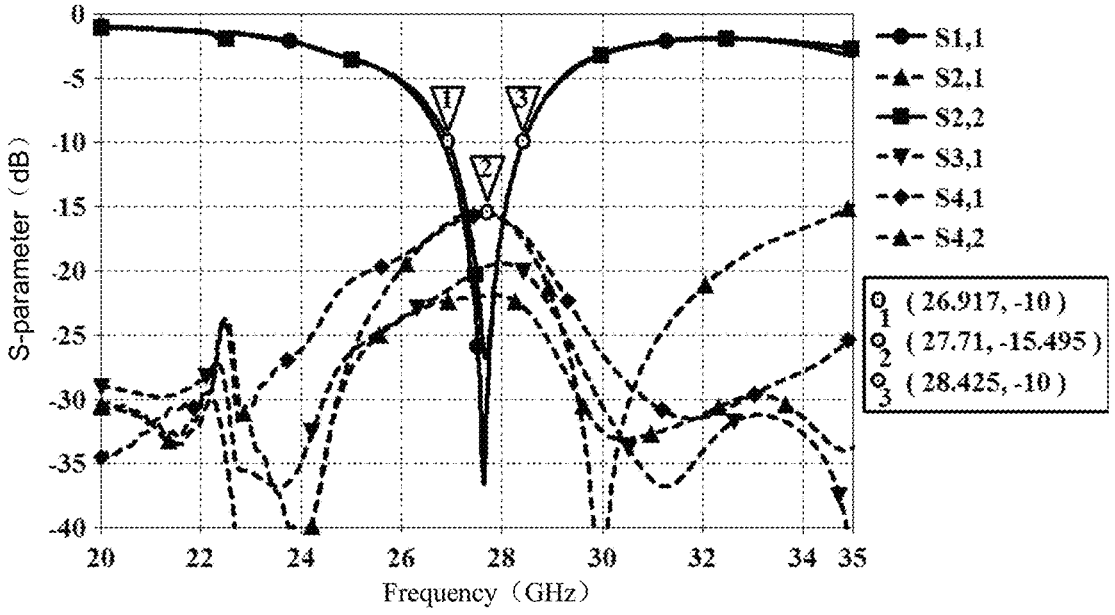
FIG. 14 is an S-parameter diagram of the antenna element in embodiment 1 of the invention.

FIG. 14 is an S-parameter diagram of the antenna element in the antenna system, wherein curve S11 and curve S22 in FIG. 14 show return losses of the two feeding ports of the antenna element, and the other curves show the isolation between the feeding ports of the surface antenna element and the adjacent antenna element. As can be seen from FIG. 14, the return loss of the antenna element from 26.9 GHz to 28.4 GHz is lower than −10 dB and accords with the American 5G millimeter-wave 28 Ghz frequency band (27.5 GHz-28.35 GHz), and the isolation between the feeding ports of the adjacent antennae elements in the whole frequency band is superior to −15 dB.

Figure 15:
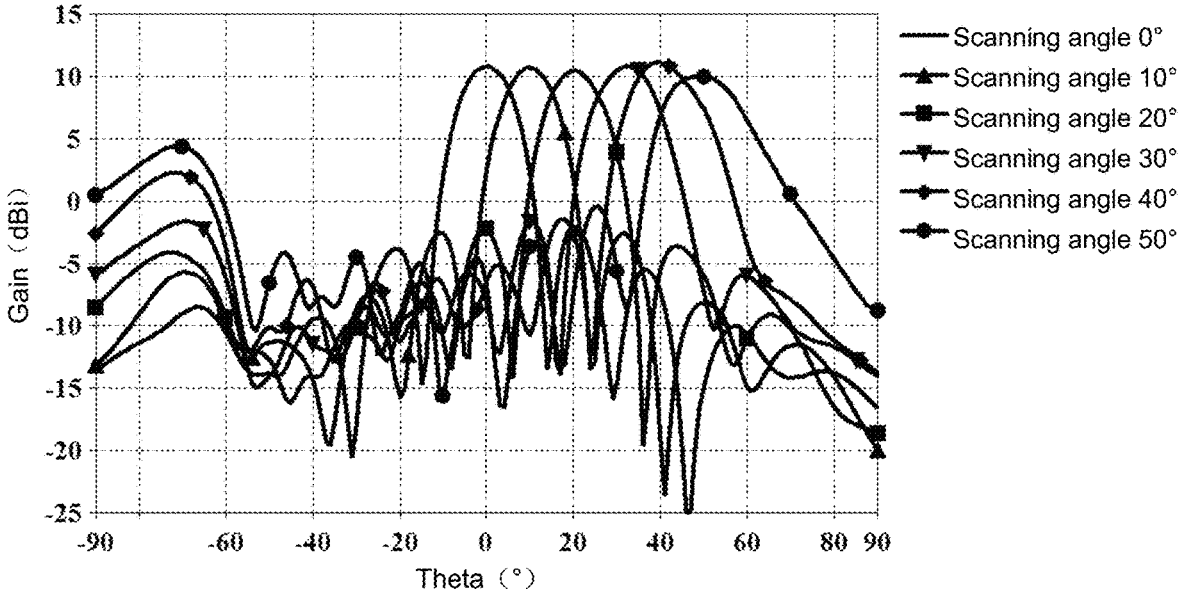
FIG. 15 is a +45° polarization pattern of the dual-polarized millimeter-wave antenna system applicable to 5G communications at the frequency of 28 GHz in Theta direction under a scanning angle of 0°-50° in the XOZ plane in embodiment 1 of the invention.
Figure 16:
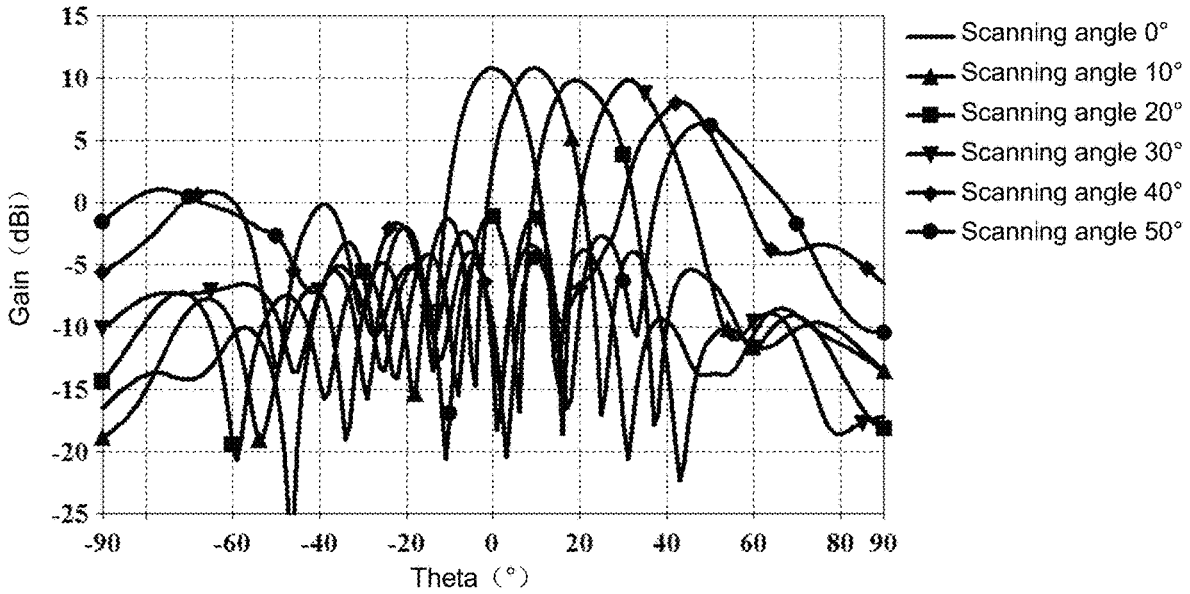
FIG. 16 is a −45° polarization pattern of the dual-polarized millimeter-wave antenna system applicable to 5G communications at the frequency of 28 GHz in Theta direction under a scanning angle of 0°-50° in the XOZ plane in embodiment 1 of the invention.

FIG. 15 is a +45° polarization pattern of the antenna system at the frequency of 28 GHz in Theta direction under a scanning angle of 0°-50° in the XOZ plane, and FIG. 16 is a −45° polarization pattern of the antenna system at the frequency of 28 GHz in Theta direction under a scanning angle of 0°-50° in the XOZ plane. Theoretically, the patterns of the two polarization directions at different scanning angles are in mirror symmetry with respect to the median of the long edges of the metal ground plate, and thus, there is a difference between the two polarization patterns at different scanning angles in FIG. 15 and FIG. 16 on the same side.

In conclusion, the dual-polarized millimeter-wave antenna system applicable to 5G communications and the mobile terminal of the invention have the advantages of dual polarization and wide-angle coverage; and the antenna system can be fabricated through the PCB process, thereby being easy to fabricate in batches and suitable for serving as a 5G communication system of the mobile terminal.

The above embodiments are only illustrative ones and are not intended to limit the patent scope of the invention. All equivalent transformations based on the specification and the accompanying drawings, or direct or indirect applications to relevant technical fields should also fall within the patent protection scope of the invention.

The invention claimed is:

1. A dual-polarized millimeter-wave antenna system applicable to 5G communications, comprising at least six antenna elements which are arranged at intervals, wherein each said antenna element comprises a radiating body and a director, the radiating body comprises a first dielectric layer, a main radiating part, a first feeding branch, a second feeding branch, a third feeding branch and a fourth feeding branch, the main radiating part, the third feeding branch and the fourth feeding branch are located on an upper surface of the first dielectric layer, the first feeding branch and the second feeding branch are located on a lower surface of the first dielectric layer, the third feeding branch is electrically connected to the first feeding branch, and the fourth feeding branch is electrically connected to the second feeding branch; the director is arranged close to the main radiating part, and an included angle is formed between a main plane of the director and a plane where the main radiating part is located; and the director comprises a second dielectric layer, a first director part and a second director part, the first director part and the second director part are separately located on two opposite sides of the second dielectric layer, and the first director part is electrically connected to the second director part.

2. The dual-polarized millimeter-wave antenna system applicable to 5G communications according to claim 1, wherein the main radiating part is rectangular or round, and the first director part and the second director part are rectangular or round.

3. The dual-polarized millimeter-wave antenna system applicable to 5G communications according to claim 2, wherein the first feeding branch and the second feeding branch are symmetrically arranged with respect to the main radiating part.

4. A mobile terminal, comprising a metal ground plate and the dual-polarized millimeter-wave antenna system applicable to 5G communications according to claim 3, wherein the dual-polarized millimeter-wave antenna system is arranged close to one side of the metal ground plate.

5. A mobile terminal, comprising a metal ground plate and the dual-polarized millimeter-wave antenna system applicable to 5G communications according to claim 2, wherein the dual-polarized millimeter-wave antenna system is arranged close to one side of the metal ground plate.

6. The dual-polarized millimeter-wave antenna system applicable to 5G communications according to claim 1, wherein the first feeding branch and the second feeding branch are in an L shape or in an arc shape.

7. The dual-polarized millimeter-wave antenna system applicable to 5G communications according to claim 6, wherein the included angle is 90°.

8. The dual-polarized millimeter-wave antenna system applicable to 5G communications according to claim 7, wherein the main radiating part is square, one diagonal line of the main radiating part is perpendicular to the main plane of the director, the first feeding branch and the second feeding branch are in an L shape and are symmetrically arranged with respect to the diagonal line, the first feeding branch comprises a first long branch and a first short branch, the first long branch is fixedly connected with the first short branch and is perpendicular to one side of the main radiating part, the second feeding branch comprises a second long branch and a second short branch, and the second long branch is fixedly connected with the second short branch and is perpendicular to another side of the main radiating part.

9. A mobile terminal, comprising a metal ground plate and the dual-polarized millimeter-wave antenna system applicable to 5G communications according to claim 8, wherein the dual-polarized millimeter-wave antenna system is arranged close to one side of the metal ground plate.

10. A mobile terminal, comprising a metal ground plate and the dual-polarized millimeter-wave antenna system applicable to 5G communications according to claim 7, wherein the dual-polarized millimeter-wave antenna system is arranged close to one side of the metal ground plate.

11. A mobile terminal, comprising a metal ground plate and the dual-polarized millimeter-wave antenna system applicable to 5G communications according to claim 6, wherein the dual-polarized millimeter-wave antenna system is arranged close to one side of the metal ground plate.

12. The dual-polarized millimeter-wave antenna system applicable to 5G communications according to claim 1, wherein each said antenna element further comprises a first ground part located on the lower surface of the first dielectric layer.

13. The dual-polarized millimeter-wave antenna system applicable to 5G communications according to claim 12, wherein each said antenna element further comprises a second ground part, a third ground part and a fourth ground part, the second ground part, the third ground part and the fourth ground part are located on the upper surface of the first dielectric layer, and the second ground part, the third ground part and the fourth ground part are electrically connected to the first ground part.

14. A mobile terminal, comprising a metal ground plate and the dual-polarized millimeter-wave antenna system applicable to 5G communications according to claim 13, wherein the dual-polarized millimeter-wave antenna system is arranged close to one side of the metal ground plate.

15. A mobile terminal, comprising a metal ground plate and the dual-polarized millimeter-wave antenna system applicable to 5G communications according to claim 12, wherein the dual-polarized millimeter-wave antenna system is arranged close to one side of the metal ground plate.

16. The dual-polarized millimeter-wave antenna system applicable to 5G communications according to claim 1, wherein the radiating body further comprises a third dielectric layer and a bonding layer, and the third dielectric layer is fixedly connected with the lower surface of the first dielectric layer through the bonding layer.

17. A mobile terminal, comprising a metal ground plate and the dual-polarized millimeter-wave antenna system applicable to 5G communications according to claim 16, wherein the dual-polarized millimeter-wave antenna system is arranged close to one side of the metal ground plate.

18. A mobile terminal, comprising a metal ground plate and the dual-polarized millimeter-wave antenna system applicable to 5G communications according to claim 1, wherein the dual-polarized millimeter-wave antenna system is arranged close to one side of the metal ground plate.

* * * * *